United States Patent [19]

Cauley et al.

[11] Patent Number: 4,822,290

[45] Date of Patent: Apr. 18, 1989

[54] ELECTRIC RECEPTACLE

[76] Inventors: William J. Cauley, 60483 Apache La., Washington, Mich. 48094; Cheatham T. Dudley, 1533 Walton, Rochester, Mich. 48063

[21] Appl. No.: 203,278

[22] Filed: Jun. 6, 1988

Related U.S. Application Data

[63] Continuation-in-part of Ser. No. 96,764, Sep. 11, 1987, Pat. No. 4,749,360, which is a continuation of Ser. No. 868,949, May 30, 1986, abandoned.

[51] Int. Cl.[4] ..... H01R 13/453

[52] U.S. Cl. ..... 439/137; 439/145

[58] Field of Search ..... 439/92, 97, 137, 145

[56] References Cited

U.S. PATENT DOCUMENTS

| | | | |
|---|---|---|---|
| 2,579,538 | 12/1951 | Bierce . | |
| 3,206,705 | 9/1965 | Smith . | |
| 3,222,631 | 12/1965 | Cohen . | |
| 3,238,492 | 3/1966 | Houston . | |
| 3,736,547 | 5/1973 | Koenig . | |
| 4,072,382 | 2/1978 | Reschke . | |
| 4,168,104 | 9/1979 | Buschow | 439/137 |
| 4,271,337 | 6/1981 | Barkas . | |
| 4,379,607 | 4/1983 | Bowden, Jr. . | |
| 4,493,517 | 1/1985 | Hillary . | |
| 4,544,219 | 10/1985 | Barkas . | |

FOREIGN PATENT DOCUMENTS

| | | | |
|---|---|---|---|
| 214335 | 3/1958 | Australia . | |
| 2434577 | 1/1976 | Fed. Rep. of Germany | 439/137 |
| 500602 | 2/1939 | United Kingdom . | |
| 620186 | 3/1949 | United Kingdom . | |
| 728693 | 4/1955 | United Kingdom . | |
| 792363 | 3/1958 | United Kingdom . | |
| 793000 | 4/1958 | United Kingdom . | |
| 2068651 | 8/1981 | United Kingdom . | |

*Primary Examiner*—Eugene F. Desmond

*Attorney, Agent, or Firm*—Brooks & Kushman

[57] ABSTRACT

An electrical receptacle for selectively receiving two prong polarized or three prong grounded electrical plugs while excluding non-polarized plugs and other foreign materials from being inserted into the receptacle apertures. The receptacle is provided with a body having an internal cavity containing an aperture shield and a locking bar. The aperture shield is biased to the closed position obstructing the receptacle aperture and is retained in the closed position by the locking bar. The locking bar shifts to the unlocked position upon the insertion of the polarized plug or a ground prong enabling the aperture shield to shift transversely to the open position in response to plug insertion.

20 Claims, 2 Drawing Sheets

ELECTRIC RECEPTACLE

RELATED APPLICATIONS

This application is a continuation-in-part of application Ser. No. 096,764, filed Sept. 11, 1987, issued as U.S. Pat. No. 4,749,360 incorporated by reference herein, which was a continuation of application Ser. No. 868,949, filed May 30, 1986, now abandoned.

FIELD OF INVENTION

This invention relates to electrical receptacles. More particularly, the invention relates to electrical receptacles provided with an internal aperture shield which limits the entry of foreign objects into the receptacle.

BACKGROUND AND OBJECTS OF THE INVENTION

Common electrical receptacles are provided with a number of open apertures into which a male electrical plug can be inserted. When the plug is not in place, these open apertures provide a path through which foreign objects and dirt may enter the electrical receptacle. Not only do foreign objects and dirt pose a problem with respect to the performance of the receptacle but the open receptacle apertures periodically cause injury to infants and small children who insert conductive objects therein. A need exists to prevent the insertion of foreign objects and dirt into an electrical receptacle aperture when the receptacle is not in use. The mechanism used to achieve this result needs to be economically feasible and convenient in order to be practical.

One method frequently employed to shield unused electrical receptacles is to insert a non-conductive dummy male plug into the receptacle to cover the apertures. Such devices are effective for young infants, however, more dexterous children in the 1½ to 3 year old age group can easily remove the dummy plugs to expose the open receptacle apertures.

A number of prior art electrical receptacles have been developed having internal aperture shields. An example of a device intended to exclude foreign objects yet allow conventional two or three prong male plugs is shown in U.S. Pat. No. 4,379,607 (Bowden). Electrical receptacles have bee provided with internal aperture shields which prevent the insertion of objects into the receptacle with the exception of plugs having a ground prong as shown in U.S. Pat. Nos. 2,579,538 (Bierce), 3,736,547 (Koenig) and 4,168,104 (Buschow). These devices restrict entry of foreign objects into the receptacle, however, standard two prong plugs may not be inserted.

A great number of electrical appliances sold today do not utilize a three prong plug. It is therefore desirable to have an electrical receptacle provided with internal aperture shields which will accept both grounded as well as ungrounded male plugs. All newer two prong appliances sold in the United States are polarized so that the plug may be only inserted in a specified orientation relative to the receptacle. Polarization is achieved by making the height of one of the two blades significantly greater than the other and sizing the corresponding apertures in the receptacle so that the plug can only be inserted the receptacle in a specific manner. It is desirable to have an electrical receptacle which will keep out foreign objects but also selectively exclude non-polarized two prong plugs which are found on obsolete and unsafe electrical appliances.

As pointed out in Barkus U.S. Pat. No. 4,544,219 prior art receptacles such as that shown in Bowden U.S. Pat. No. 4,379,607 are compatable only with 15 amp plugs and cannot offer protection in applications such as hospitals, child care centers, institutional or commercial buildings where the more common receptacles the 20 amp type. Barkus addressed this problem using a two shutter mechanism, designed to operate when two objects of sufficient rigidity are inserted in the slots. Barkus like Bowden, Jr., have the same inherent problem, all that is required to operate the shutters are objects of sufficient rigidity such as hair pins, keys, nail files, toys or like objects. It was with this deficiency in mind that the present safety receptacle was developed. What was needed to meet the requirements of the National Electric Code was a new and novel receptacle that could determine if the attempted insertion of objects into the aperture openings are foreign objects or a legitimate NEMA plug component (National Electric Manufacturers Association). This invention solves that problem, operating like an intelligent lock, it measures the object inserted and if the key fits it opens. The key being a component or components of a plug that must meet NEMA dimensions. Working models have proved that the receptacle will recognize as little as 0.003 of an inch of variation from NEMA design standards. The invention can be utilized with plug components that are parallel, perpendicular, T-Slot, L-slot, 2 blade, 3 blade, blades of different dimensions or any combination that would be required. The receptacle illustrated in the drawings is of a NEMA 5–20 configuration, however, the receptacle could be modified so the slide is capable of travel in either direction as would be required in a NEMA 6–20. Also, the number of shiftable locks could be increased to monitor any number of plug blade dimensions.

Accordingly, it is an object of the present invention to provide an electrical receptacle having an internal aperture shield preventing the entry of dirt and foreign objects into the receptacle openings. It is a further object of the invention to allow the aperture shield to automatically open upon the insertion of a grounded three prong plug or a polarized two prong plug and to selectively exclude non-polarized two prong plugs and foreign objects.

Another object of the present invention is to enable a receptacle to accept a twenty-amp plug having the conductive blades oriented at right angles to one another. A advantage of the present invention is that the desired performance characteristics can be obtained quite economically.

These and other objects, features and advantages of the invention will be apparent upon further review of the description of the preferred embodiment.

SUMMARY OF THE INVENTION

Accordingly, an electrical receptacle of the present invention includes a receptacle body, an internal aperture shield, and an internal locking bar. A receptacle body is provided with a conventional internal cavity containing electrical contacts and a face plate having ground prong and first and second blade receiving apertures. The aperture shield is formed of non-conductive material and is shiftable transversely relative to the body's longitudinal axis between a closed position in which the first and second blade apertures are obstructed to an open position in which an electrical plug may be inserted into the receptacle. The locking bar is located within the body's internal cavity and is shiftable between the locked position in which the locking bar retains the aperture shield in the closed position and an unlocked position in which the aperture shield is free to shift transversely. Means are provided to move the locking bar to the unlocked position upon insertion of a polarized two prong plug or upon the insertion of a grounded three prong plug thereby excluding a non-polarized two prong plugs and foreign objects from being inserted in the receptacle.

BRIEF DESCRIPTION OF THE PREFERRED EMBODIMENT

Figure 1:
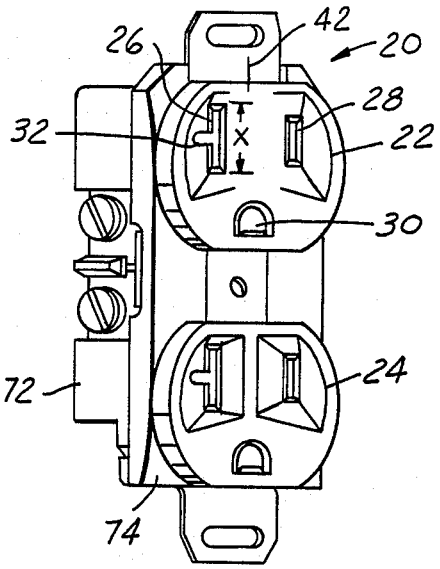
FIG. 1 is a perspective view of the preferred embodiment of the invention.

Referring to the drawings, FIG. 1 shows a perspective view of an electrical receptacle of the present invention. The receptacle shown in FIG. 1 is not significantly different in outside appearance to standard receptacles since the invention is located entirely within the internal cavity of the receptacle body. Electrical receptacle 20 is provided with a pair of outlets 22 and 24, each capable of receiving an electrical plug. Electrical receptacle 20 is of the twenty-amp variety as evidenced by the generally T-shaped first blade aperture 26. First blade aperture 26 has a height X which is substantially greater than the height of second blade aperture 28. First and second blade apertures 26 and 28 enable a polarized, two prong plug to be inserted into the receptacle in a single predetermined orientation with the plug first blade fitting into first aperture 26 and the plug second blade fitting within second blade aperture 28. The electrical receptacle outlet is also provided with a ground prong aperture 30 sized to receive the ground prong of a standard three prong plug.

T-shaped first blade aperture 26 is provided with a transverse slot 32 which extends generally perpendicular to the longitudinal slot utilized for conventional fifteen-amp plugs. Transverse slot 32 enables twenty-amp three prong plugs which have generally perpendicular blades to be inserted into the electrical receptacle. It should be noted, however, that the invention is not limited to twenty-amp receptacles. Twenty-amp receptacles, in fact, will represent a relatively small portion of the market for the invention since most household amplications utilize fifteen-amp receptacles.

Figure 2:
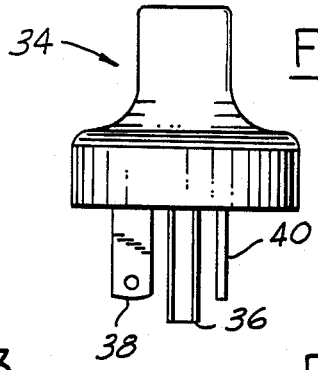
FIG. 2 is a side elevation of a twenty-amp three prong electrical plug.
Figure 3:
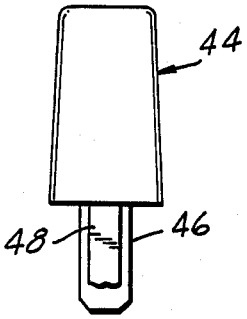
FIG. 3 is a side elevation of a polarized two prong fifteen-amp plug.
Figure 4:
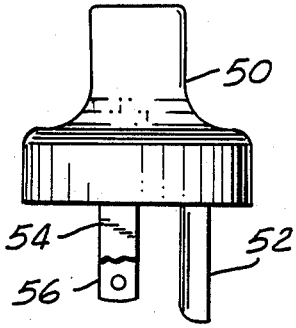
FIG. 4 is a side elevation of a unpolarized three prong, grounded fifteen-amp plug.

FIGS. 2–4 show the various electrical plugs which electrical receptacle 20 is designed to receive. FIG. 2 depicts the side elevation of a twenty-amp three prong plug 34. Plug 34 is provided with a ground prong 36, a first conductive blade 38 and a second conductive blade 40. Conductive blades 38 and 40 are generally perpendicular to one another. When electrical plug 34 is inserted into the receptacle outlet 22, ground prong 36 will be inserted within ground prong aperture 30, first blade 38 will be inserted into transverse slot 32 of the first blade aperture 26 and second blade 40 will be inserted into second blade aperture 28. Relative to the longitudinal axis 42 of the outlet, first blade 38 and the corresponding first blade aperture transverse slot 32 are oriented generally perpendicular to longitudinal axis 42 while the second blade 40 and corresponding second blade aperture 28 are generally parallel to longitudinal axis 42. Longitudinal axis extends generally through the ground prong aperture 30 and extending between the first and second blade apertures 28 and 32 shown.

FIG. 3 depicts a conventional, polarized two prong electrical plug 44. Plug 44 is provided with a first blade 46 and a second blade 48 shown partially broken away. The first and second blades are of substantially the same thickness and length, however, the blade height is substantially different as shown. First blade 46 is sized to fit within first blade aperture 26, however, the height of the second blade aperture 28 is insufficient to allow first blade 46 of polarized plug 44 to fit therein. As a result of the differences in the height of blades 46 and 48 and the corresponding blade apertures 26 and 28, the plug 44 will only fit within the receptacle outlet in a single orientation.

FIG. 4 depicts a conventional fifteen-amp, grounded three prong plug 50. Plug 50 is provided with a ground prong 52, first blade 54 and second blade 56. First blades 54 and 56 are substantially the same length, thickness and height. Since the presence of ground prong 52 enables the three prong plug to be inserted in an electrical outlet only in a single orientation, there is no need to polarize the two blades.

Figure 5:
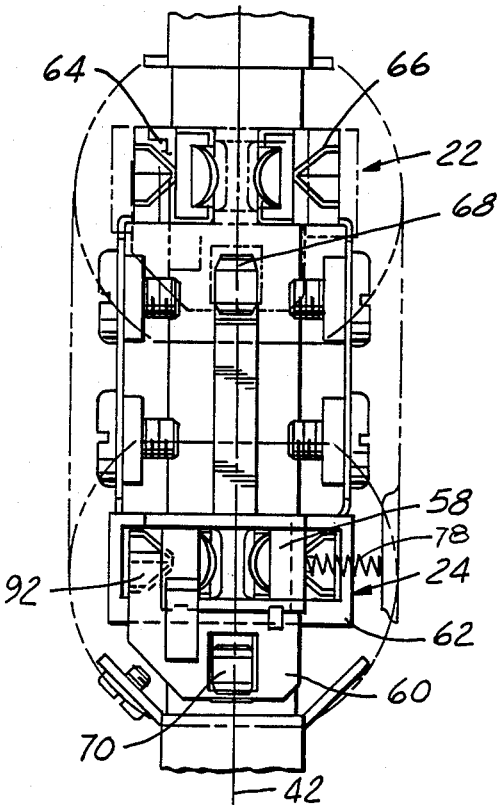
FIG. 5 is a cut-away plan view of a preferred embodiment of the invention with the aperture shield of the upper outlet removed to expose the contacts and the aperture shield of the lower outlet shown in the closed, locked position.
Figure 6:
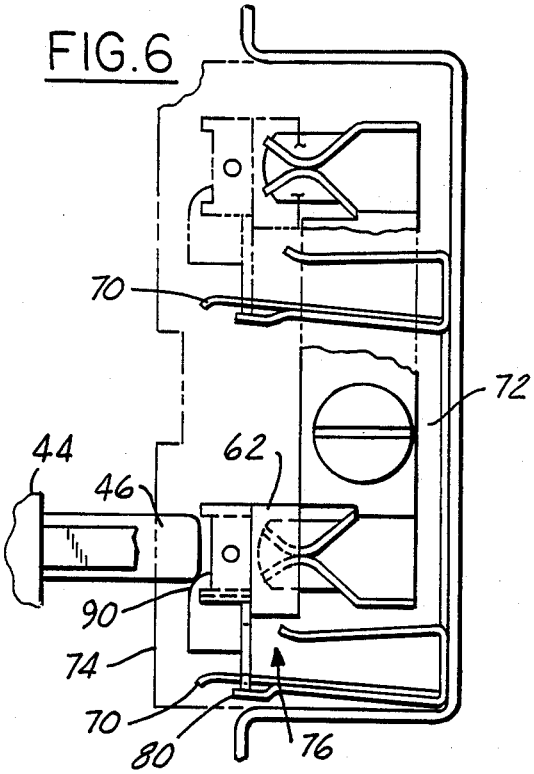
FIG. 6 is a cut-away side elevation of the invention showing a polarized two-prong plug being initially inserted.

FIG. 5 shows a plan view of an electrical receptacle of the present invention with the cover plate and some additional parts removed so as to expose the receptacle's internal structure. The lower outlet 24 is provided with an aperture shield 58, a locking bar 60, a support block 62 which is generally superimposed above the conventional receptacle electrical contacts. Upper outlet 22 is shown with the aperture shield locking bar and support plate removed so that the electrical contacts of the receptacle can be shown. The contacts are conventionally formed of a springy metallic material such as brass or the like to securely engage the conductive blades and prongs of the plug inserted therein. First and second contact assemblies 64 and 66 are designed to removably engage the first and second blades of an electrical plug. Each of the contact assemblies are made up of three electrical conductors so that a longitudinal or transverse blade may be inserted therein. While the second contact assembly will never engage a transverse blade, these contact assemblies are typically identical in construction to minimize the number of different parts of the electrical receptacle. The electrical receptacle is also provided with a ground prong contact assembly 68 formed of a generally U-shaped cantilever spring having a free end 70 which is best shown in FIG. 6 in cross-sectional view. As can be seen by comparing the orientation of the aperture shield shown superimposed upon the electrical contacts on outlet 24 in FIG. 5 with the electrical contacts of upper outlet 22, the aperture shield in the closed position shown obstructs the entry of any object into the first and second contact assemblies 64 and 66.

The electrical receptacle 20 is provided with a plastic body 72 which has face plate 74 attached thereto to define an internal cavity therein. The electrical contacts and the aperture shield assembly 20 are sized to fit within the internal cavity of the body. First and second blade apertures 26 and 28 and ground plug aperture 30 extend through face plate 74 into the body's internal cavity 76 in a conventional manner. In the preferred embodiment shown in the drawings, support block 62 is mounted to body 72 adjacent first and second contact assemblies 64 and 66. Support block 62 is provided with an upper substantially flat surface upon which aperture shield 58 slides. Aperture shield is slidably shiftable transversely relative to the receptacle longitudinal axis 42 and formed of a non-conductive material. The aperture shield is biased to the closed position by spring 78 which serves as a means for biasing the aperture shield to the closed position. Springs of other shapes or other elastomeric devices could be utilized in place of the coil spring configuration.

Figure 7:
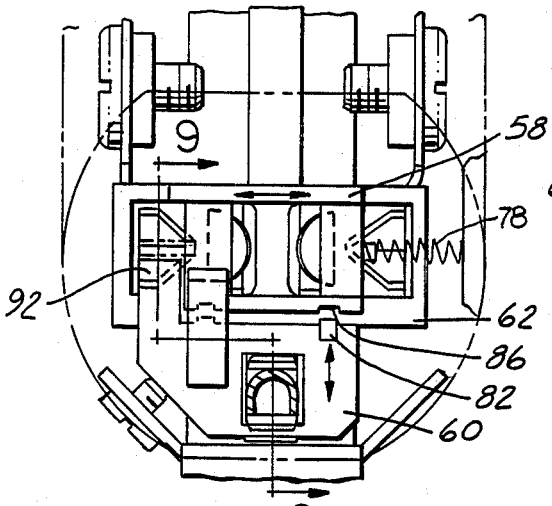
FIG. 7 is a enlarged partial cut-away plan view showing the aperture shield in the closed but unlocked position.
Figure 8:
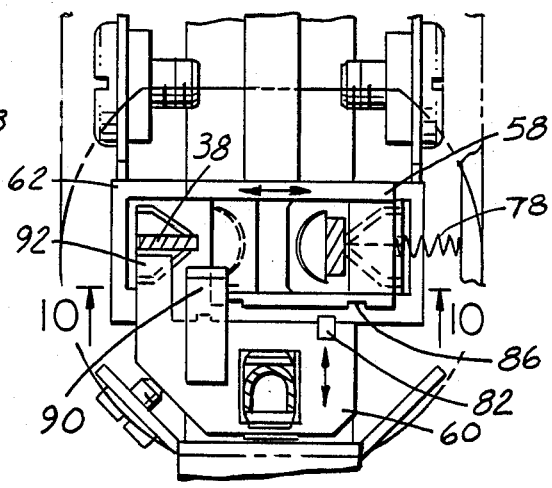
FIG. 8 is an enlarged partial cut-away plan view showing the aperture shield in the unlocked position.

Locking bar 60 also formed on a non-conductive material cooperates with and is shiftable longitudinally relative to aperture shield 58. When in the locked position shown in FIG. 5, the locking bar 60 will prevent the aperture shield from sliding. In FIG. 7, locking bar 60 is shown in the unlocked position thereby enabling the aperture shield 58 to slide transversely. Although locking bar 60 is moved to the unlocked position the aperture shield will still be biased to the closed position by spring 78.

Figure 9:
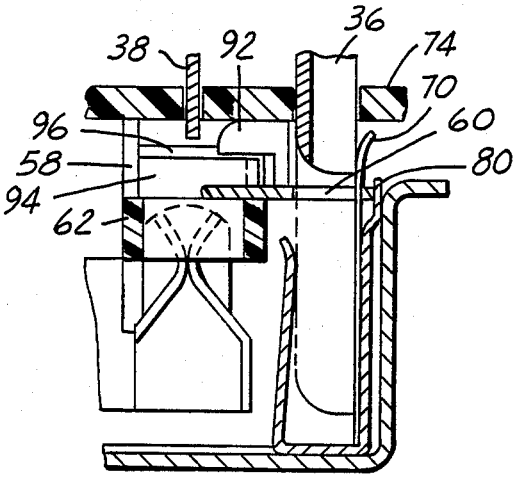
FIG. 9 is an enlarged cut-away side elevation taken along the lines 9—9 of FIG. 7.
Figure 10:
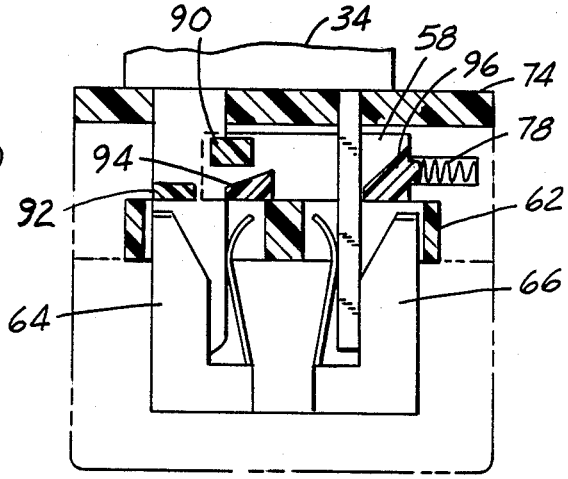
FIG. 10 is an enlarged cross-sectional end view taken along the line 10—10 of FIG. 8.

Locking bar 60, shown in FIG. 9, is attached to ground prong spring free end 70 by a retainer 80. The ground prong spring serves as a means for biasing the locking bar 60 to the locked position. When an electrical plug having a ground prong is partially inserted into the receptacle, the plug ground prong 36 will deflect the ground prong spring 70 thereby shifting the locking bar 60 to the unlocked position shown in FIG. 7. Locking bar 60 is provided with two locking bolts 82 and 84 which cooperate with slots 86 and 88 formed in aperture shield 58. It should be noted, however, that the bolt may be on the aperture shield and the slot in the locking bar or other means for locking the two parts together to prevent transverse movement of the aperture shield may be provided.

Figure 11:
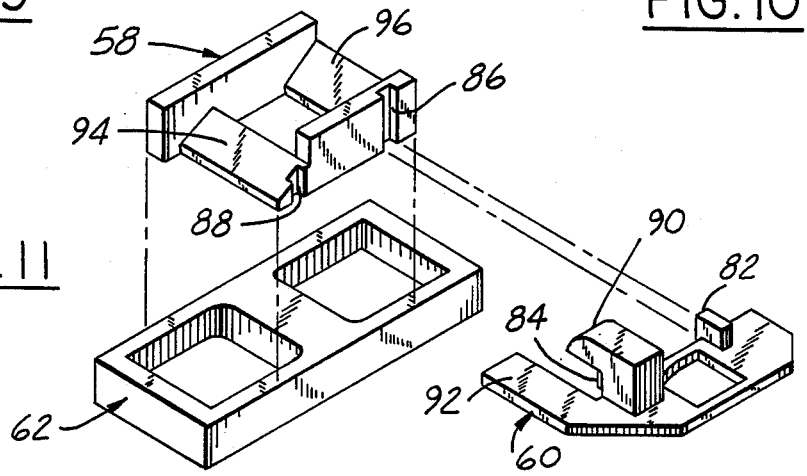
FIG. 11 is an exploded perspective view of the aperture shield, locking bar and support block.

The construction of the aperture shield and the locking bar are best shown in FIG. 11. In order to move the locking bar to the unlocked position upon the insertion of a ungrounded, polarized plug the locking bar is provided with a ramp 90 designed to cooperate with the first blade of a polarized plug. As shown in FIG. 6, a polarized plug first blade when partially inserted engages ramp 90 causing the locking bar to shift longitudinally releasing the aperture shield. When a non-polarized two prong plug is inserted, the plug's first blade will have insufficient width to engage ramp 90, therefore, the aperture shield will remain locked preventing plug insertion.

It should be further noted that locking bar 60 is provided with tab 92 which also serves to obstruct the transverse slot 32 portion of the T-shaped first blade aperture 26. As best shown in FIG. 5, the longitudinal portion of the first blade aperture is blocked by the aperture shield. The transverse slot 32 in the face plate and the corresponding electrical contact assembly 64 located therebelow is obstructed by tab 92. This construction enables the entire T-shaped first blade aperture to be effectively shielded while minimizing a necessary aperture shield travel.

Once the locking bar has been moved to the unlocked position it is next necessary to shift the aperture shield to the open position to enable further plug insertion. Aperture shield 58 is provided with a first and second cross member 94 and 96 oriented longitudinally parallel to one another in a spaced apart relationship corresponding generally to the spacing of the plug blades. At least one and preferably both of the cross members 94 and 96 have an upper inclined surface for cooperation with the blades of an electrical plug. If the surface of the cross members are inclined sufficiently that when the blade of the plug is urged against the cross member the aperture shield will be shifted transversely to the open position at an amount sufficient to enable the plug to fully enter the receptacle and make electrical contact. When the plug is in the fully inserted position, spring 78 will continue to bias the aperture shield transversely against the plug blades. Upon removal of the plug from the receptacle, the aperture shield will immediately return to the closed position and the locking bar will return to the locked position to securely obstruct the first and second blade apertures once again.

Three prong fifteen-amp as well as three prong twenty-amp plugs insert into the receptacle in a substantially similar manner. In both instances, the ground prong partial insertion serves to shift the locking bar 60 to the unlocked position and further insertion of the plug causes the plug blades to engage the shield cross members of the aperture shield. In the case of the twenty-amp plug the second plug blade will engage the upper inclined surface of the second shield cross member 96 causing the aperture shield 58 to shift transversely to the unlocked position overcoming the biasing force of spring 78. Due to the first blade orientation of a twenty-amp plug the first blade may not contact the first shield cross member 94. In the preferred embodiment, first shield cross member 94 has a significantly less of a slope than second shield cross member 96. This is done for the purpose of enabling the ramp 90 of locking bar 60 to project over first shield cross member 94 as shown in FIG. 9.

The preferred embodiment in the invention described is designed to be capable of receiving three prong grounded plugs as well as two prong polarized plugs. It should be appreciated that the invention could be modified simply by removing the locking bar at 90 if it was desired to exclude all of two prong plugs and only allow the insertion of grounded three prong plugs. The receptacle could be modified to allow unpolarized plugs to be inserted while still excluding foreign objects. If unpolarized plugs are to be accepted ramp 90 will simply be relocated to cooperate with the plug's second conductive blade. The receptacle can be modified for applications where it is desired to only allow plugs which are grounded to be inserted, this modification can be readily made without departing from the scope of the invention claimed.

It should be also understood, of course, that while the invention herein shown and described constitutes a preferred embodiment of the invention it is not intended to illustrate all possible forms thereof. Receptacles having any number of outlets can be fabricated and various alternative apertures shield and locking bar structures can be created by one of ordinary skill in the art without departing from the spirit and scope of the invention disclosed in the claims.

What is claimed is:

1. An electrical receptacle for receiving electrical plugs having two polarized conductive blades or two conductive blades and a ground prong, said electrical receptacle comprising:

a body having a longitudinal axis and an internal cavity covered by a face plate, said face plate provided with a ground prong aperture and first and second blade apertures sized to receive the blades of a polarized plug, said longitudinal axis extending between first and second blade apertures and aligned with the ground prong aperture, said apertures extending into said internal cavity;

an aperture shield located in the internal cavity of the body formed of a non-conductive material, shiftable transversely relative to the longitudinal axis between an open and closed position, said aperture shield provided with a first and second cross member for cooperating with the conductive blades of the electrical plug, in the closed position the electrically conductive blades engage the first and second cross member preventing further blade insertion and at least one of which having an inclined surface for urging the aperture shield to the open position;

locking means for normally retaining the aperture shield in the closed position and for releasing the aperture shield upon the partial insertion of a polarized plug or a plug having a ground prong, thereby enabling the aperture shield to shift to the open position in response to engagement with the electrically conductive blades of the plug;

means for resiliently biasing the aperture shield to the closed position; and wherein said electrical receptacle will selectively exclude non-polarized ungrounded electrical plugs.

2. The invention of claim 1 wherein said locking means further comprises:

a locking bar located within the body internal cavity shiftable between a locked position in which the locking bar retains the aperture shield in the closed position, and an unlocked position in which the aperture shield is free, said locking bar provided with means for preventing aperture shield shifting, and means for cooperating with blades of the polarized electrical plug and means for cooperating with an electrical plug ground prong to shift the locking bar to the unlocked position upon the partial insertion of the plug; and means for resiliently biasing the aperture shield in the closed position.

3. The invention of claim 2 wherein said means for resiliently biasing the locking bar further comprises a cantilever spring forming a ground prong contact shiftable longitudinally in response to ground prong insertion cooperating with the locking bar to shift same between the open and closed position upon the insertion or removal of the ground plug.

4. The invention of claim 2 wherein said locking bar is shiftable longitudinally between the locked and unlocked positions.

5. The invention of claim 4 wherein said means for resiliently biasing the locking bar further comprises a cantilever spring forming a ground prong contact shiftable longitudinally in response to ground prong insertion cooperating with the locking bar to shift same between the open and closed position upon the insertion or removal of the ground plug.

6. The invention of claim 4 wherein said locking bar further comprises an inclined ramp oriented adjacent the first blade aperture and sized to cooperate with a polarized plug blade but not an unpolarized plug blade to shift the locking bar to the unlocked position.

7. The invention of claim 6 wherein said means for resiliently biasing the locking bar further comprises a cantilever spring forming a ground prong contact shiftable longitudinally in response to ground prong insertion cooperating with the locking bar to shift same between the open and closed position by the insertion or removal of the ground plug.

8. The invention of claim 4 wherein said first blade aperture is generally T-shaped for receiving first plug blades which are oriented parallel to or perpendicular to said receptacle longitudinal axis.

9. The invention of claim 8 wherein said locking bar further comprises a tab for obstructing the transverse portion of the first blade aperture when the locking bar is in the locked position.

10. The invention of claim wherein said means for preventing aperture shield shifting further comprises a locking bolt and corresponding slot formed in a locking bar and aperture shield shiftable relative to one another along a longitudinal axis between a locked and unlocked position.

11. The invention of claim 10 wherein said locking bar further comprises an inclined ramp oriented adjacent the first blade aperture and sized to cooperate with a polarized plug blade but not an unpolarized plug blade to shift the locking bar to the unlocked position.

12. The invention of claim 2 wherein said locking bar further comprises an inclined ramp oriented adjacent the first blade aperture and sized to cooperate with a polarized plug blade but not an unpolarized plug blade to shift the locking bar to the unlocked position.

13. The invention of claim 12 wherein the aperture shield second cross member is provided with an inclined surface for engagement with the plug second blade to urge the aperture shield transversely to the open position.

14. An electrical receptacle for alternatively receiving an electrical plug having two polarized electrically conductive planar blades or an electrical plug having a ground prong and two electrically conductive planar blades, said electrical receptacle comprising:

a body having a longitudinal axis and an internal cavity covered by a face plate provided with a ground prong receiving aperture, and first and second blade apertures sized to receive the blades of a polarized plug in a single orientation, said apertures extending into said internal cavity, said internal cavity receiving the blades of an electrical plug, said longitudinal axis generally aligned with the ground prong aperture and extending between the first and second blade apertures;

an aperture shield located within the body internal cavity adjacent the face plate formed of a non-conductive material, said aperture shield being slidably shiftable transversely relative to the longitudinal axis and generally perpendicular to the blades of the electrical plug between an open position in which the electrical plug may be inserted into the electrical receptacle, and a closed position in which insertion is prevented, said aperture shield provided with a first and second shield cross member at least one of which having an inclined surface for cooperating with an electrically conductive blade of the plug;

a locking bar located within the body internal cavity shiftable between a locked position in which the locking bar retains the aperture shield in the closed position, and an unlocked position in which the aperture shield is free, said locking bar provided with means for preventing aperture shield shifting, and means for cooperating with the blades of a polarized electrical plug and means for cooperating with an electrical plug ground prong to shift the locking bar to the unlocked position upon the partial insertion of the plug;

means for resiliently biasing the aperture shield in the closed position; and means for resiliently biasing the locking bar to the locked position;

wherein said electrically conductive blades will engage the shield cross member upon plug insertion in the receptacle, thereby urging the aperture shield to the open position, said electrical receptacle accepting an electrical plug having a ground prong or polarized conductive blades which release the locking bar and excluding non-polarized ungrounded electrical plugs which do not shift the locking bar.

15. The invention of claim 14 wherein said means for resiliently biasing the locking bar further comprises a cantilever spring forming a ground prong contact shiftable longitudinally in response to ground prong insertion cooperating with the locking bar to shift same between the open and closed position by the insertion or removal of the ground plug.

16. The invention of claim 14 wherein said locking bar further comprises an inclined ramp oriented adjacent the first blade aperture and sized to cooperate with a polarized plug blade but not an unpolarized plug blade to shift the locking bar to the unlocked position.

17. The invention of claim 16 wherein said means for resiliently biasing the locking bar further comprises a cantilever spring forming a ground prong contact shiftable longitudinally in response to ground prong insertion cooperating with the locking bar to shift same between the open and closed position by the insertion or removal of the ground plug.

18. The invention of claim 17 wherein said means for resiliently biasing the aperture shield further comprises a spring cooperating with the aperture shield and the body.

19. The invention of claim 14 wherein said means for preventing aperture shield shifting further comprises a locking bolt and corresponding slot formed in a locking bar and aperture shield shiftable relative to one another along a longitudinal axis between a locked and unlocked position.

20. An electrical receptacle for removably receiving an electrical plug having a ground prong and two electrically conductive blades, said electrical receptacle comprising:

a body having a longitudinal axis and an internal cavity covered by a face plate provided with a ground prong receiving aperture and first and second blade apertures, said apertures extending into said internal cavity for receiving the blades of an electrical plug, said longitudinal axis generally aligned with the ground prong aperture and extending between the first and second blade apertures;

an aperture shield located within the body internal cavity adjacent the face plate formed of a non-conductive material, said aperture shield being slidably shiftable transversely relative to the longitudinal axis and generally perpendicular to the blades of the electrical plug between an open position in which the electrical plug may be inserted into the electrical receptacle, and a closed position in which insertion is prevented, said aperture shield provided with a first and second shield cross member at least one of which having an inclined surface for cooperating with an electrically conductive blade of the plug;

a locking bar located within the body internal cavity shiftable between a locked position in which the locking bar retains the aperture shield in the closed position and an unlocked position in which the aperture shield is free, said locking bar provided with means for preventing aperture shield shifting, and means for cooperating with an electrical plug ground prong to shift the locking bar to the unlocked position upon the partial insertion of the plug;

means for resiliently biasing the aperture shield in the closed position; and means for resiliently biasing the locking bar to the locked position;

wherein an electrically conductive blade will engage the shield cross member ramp upon plug insertion in the receptacle, thereby urging the aperture shield to the open position, said electrical receptacle accepting an electrical plug having a ground prong which releases the locking bar and excludes ungrounded electrical plugs.

* * * * *

UNITED STATES PATENT AND TRADEMARK OFFICE

CERTIFICATE OF CORRECTION

PATENT NO. : 4,822,290

DATED : April 18, 1989

INVENTOR(S) : William J. Cauley and C. Truman Dudley

It is certified that error appears in the above-identified patent and that said Letters Patent is hereby corrected as shown below:

Column 8, Line 33, (Appln. Page 17, Line 28) after "claim", insert --4--.

Signed and Sealed this

Twenty-sixth Day of September, 1989

*Attest:*

DONALD J. QUIGG

*Attesting Officer*

*Commissioner of Patents and Trademarks*